US011415068B2

(12) United States Patent
Ferrara et al.

(10) Patent No.: US 11,415,068 B2
(45) Date of Patent: Aug. 16, 2022

(54) SYSTEM AND METHOD FOR CONTROLLING ENGINE OPERATING PARAMETERS DURING ENGINE WARM-UP TO REDUCE EMISSIONS

(71) Applicant: GM GLOBAL TECHNOLOGY OPERATIONS LLC, Detroit, MI (US)

(72) Inventors: Umberto Ferrara, Turin (IT); Filippo Lachina, Turin (IT); Gianmaria Manassero, Beinasco (IT); Domenico Maccarrone, Settimo Torinese (IT); Claudio Cortassa, Rosta (IT); Marco Cibella, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 241 days.

(21) Appl. No.: 16/539,060

(22) Filed: Aug. 13, 2019

(65) Prior Publication Data

US 2021/0047974 A1 Feb. 18, 2021

(51) Int. Cl.

| | |
|---|---|
| ***F02D 41/00*** | (2006.01) |
| ***F02D 41/02*** | (2006.01) |
| ***F02D 41/14*** | (2006.01) |
| ***F02B 37/18*** | (2006.01) |

(52) U.S. Cl.

CPC ..... *F02D 41/0052* (2013.01); *F02B 37/18* (2013.01); *F02D 41/0027* (2013.01); *F02D 41/024* (2013.01); *F02D 41/1446* (2013.01); *F02D 2041/0067* (2013.01); *F02D 2200/0408* (2013.01)

(58) Field of Classification Search

CPC ..... F02D 41/0052; F02D 41/024; F02D 41/1446; F02D 41/0027; F02D 2200/0408; F02D 2041/0067; F02D 41/2422; F02D 41/1441; F02D 41/0072; F02D 41/402; F02D 41/40; F02D 41/0007; F02B 37/18

USPC ..... 701/108

See application file for complete search history.

(56) References Cited

U.S. PATENT DOCUMENTS

2013/0213349 A1* 8/2013 Sellnau ..... F02D 41/401 123/295
2015/0113981 A1* 4/2015 Marlett ..... F02D 41/0007 60/602
2015/0308332 A1* 10/2015 Oh ..... F02D 41/0007 60/605.2

(Continued)

*Primary Examiner* — Joseph J Dallo
*Assistant Examiner* — Scott A Reinbold

(57) ABSTRACT

A system includes a temperature sensor configured to measure a temperature of exhaust gas produced by an engine, and a boost error module configured to determine a boost error of the engine. The system further includes a combustion control module configured to select at least one of a target boost pressure of the engine, a target EGR flow rate of the engine, and a target fuel injection parameter of the engine from a first set of target values when the exhaust gas temperature is less than a predetermined temperature and the boost error is less than a predetermined value, and to select the at least one of the target boost pressure, the target EGR flow rate, and the target fuel injection parameter from a second set of target values when the exhaust gas temperature is less than the predetermined temperature and the boost error is greater than the predetermined value.

8 Claims, 6 Drawing Sheets

(56) References Cited

U.S. PATENT DOCUMENTS

2017/0030260 A1* 2/2017 Nishio ..... F02B 37/183
2020/0386137 A1* 12/2020 Adelman ..... F01N 3/208

* cited by examiner

SYSTEM AND METHOD FOR CONTROLLING ENGINE OPERATING PARAMETERS DURING ENGINE WARM-UP TO REDUCE EMISSIONS

FIELD

The present disclosure relates to systems and methods for controlling engine operating parameters during engine warm-up to reduce emissions.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Aftertreatment systems include components that reduce emissions in exhaust produced by a diesel engine. Some aftertreatment systems include a diesel oxidation catalyst, a selective catalytic reduction filter (SCRF) catalyst, and a selective catalytic reduction (SCR) catalyst. The diesel oxidation catalyst reduces carbon monoxide, hydrocarbons, and particulate matter emissions. The SCRF catalyst reduces nitrogen oxide emissions and traps soot (PM emissions). The SCR catalyst simply reduces nitrogen oxide emissions.

When an engine is started after the engine is shutdown for a while, components of an aftertreatment system do not operate efficiently (i.e., reduce emissions effectively) until the components are heated to their respective normal operating temperatures. In addition, an engine may produce more emissions when the engine completes a dynamic maneuver, such a rapid acceleration, relative to the amount of emissions produced by the engine during steady-state conditions, such as an unchanging engine speed. Thus, reducing emissions to acceptable levels during engine warmup and/or during a dynamic maneuver presents unique challenges.

SUMMARY

A first system according to the present disclosure includes a first exhaust gas temperature sensor, a boost error module, and a combustion control module. The first exhaust gas temperature sensor is configured to measure a first temperature of exhaust gas produced by an engine at a first location in an exhaust system of the engine. The boost error module is configured to determine a boost error of the engine. The boost error is a difference between a target boost pressure of the engine and a current boost pressure of the engine. The combustion control module is configured to take the following actions when the first exhaust gas temperature is less than a first predetermined temperature: select at least one of the target boost pressure, a target exhaust gas recirculated (EGR) flow rate of the engine, and a target fuel injection parameter of the engine from a first set of target values when the boost error is less than or equal to a predetermined value; and select the at least one of the target boost pressure, the target EGR flow rate, and the target fuel injection parameter from a second set of target values when the boost error is greater than the predetermined value, where the second set of target values is different than the first set of target values.

In one example, the combustion control module is configured to select the at least one of the target boost pressure, the target EGR flow rate, and the target fuel injection parameter from the first and second sets of target values based on at least one of a speed of the engine and a load on the engine.

In one example, when the first exhaust gas temperature is less than the first predetermined temperature, the combustion control module is configured to: select the target fuel injection parameter from the first set of target values when the boost error is less than or equal to the predetermined value; and select the target fuel injection parameter from the second set of target values when the boost error is greater than the predetermined value.

In one example, the target fuel injection parameter includes at least one of a target fuel injection timing and a target number of fuel injections for a cylinder of the engine during each combustion cycle of the engine.

In one example, when the first exhaust gas temperature is less than the first predetermined temperature, the combustion control module is configured to: adjust the target fuel injection timing to a first fuel injection timing when the boost error is less than or equal to the predetermined value; and adjust the target fuel injection timing to a second fuel injection timing when the boost error is greater than the predetermined value, where the second fuel injection timing is advanced relative to the first fuel injection timing.

In one example, when the first exhaust gas temperature is less than the first predetermined temperature, the combustion control module is configured to: adjust the target number of fuel injections to a first number when the boost error is less than or equal to the predetermined value; and adjust the target number of fuel injections to a second number when the boost error is greater than the predetermined value, where the second number is less than the first number.

In one example, when the first exhaust gas temperature is less than the first predetermined temperature, the combustion control module is configured to: select the target boost pressure, the target EGR flow rate, and the target fuel injection parameter from the first set of target values when the boost error is less than or equal to the predetermined value; and select the target boost pressure, the target EGR flow rate, and the target fuel injection parameter from the second set of target values when the boost error is greater than the predetermined value.

In one example, the first system further includes a second exhaust gas temperature sensor configured to measure a second temperature of exhaust gas produced by the engine at a second location in the exhaust system, where the combustion control module is configured to: select the target boost pressure, the target EGR flow rate, and the target fuel injection parameter from the first set of target values when the boost error is less than or equal to the predetermined value and the second exhaust gas temperature is less than or equal to a second predetermined temperature; select the target boost pressure, the target EGR flow rate, and the target fuel injection parameter from the second set of target values when the boost error is greater than the predetermined value and the second exhaust gas temperature is less than or equal to the second predetermined temperature; select the target boost pressure, the target EGR flow rate, and the target fuel injection parameter from a third set of target values when the boost error is less than or equal to the predetermined value and the second exhaust gas temperature is greater than the second predetermined temperature; and select the target boost pressure, the target EGR flow rate, and the target fuel injection parameter from a fourth set of target values when the boost error is greater than the predetermined value and the second exhaust gas temperature is greater than the second predetermined temperature.

In one example, for the same engine speed and the same engine load, the target boost pressure in the first set of target values is greater than the target boost pressure in the third set of target values, and the target boost pressure in the second set of target values is greater than the target boost pressure in the fourth set of target values.

In one example, for the same engine speed and the same engine load, the target EGR flow rate in the first set of target values is less than the target EGR flow rate in the third set of target values, and the target EGR flow rate in the second set of target values is less than the target EGR flow rate in the fourth set of target values.

In one example, the target fuel injection parameter includes a target injection quantity, the target injection quantity in the first and second sets of target values has a first variability, and the target injection quantity in the third and fourth sets of target values has a second variability that is greater than the first variability.

In one example, the first exhaust gas temperature sensor is located at an inlet of a selective catalytic reduction (SCR) catalyst in the exhaust system, the second exhaust gas temperature sensor is located at an inlet of a diesel oxidation catalyst in the exhaust system, and the second predetermined temperature is greater than the first predetermined temperature.

A second system according to the present disclosure includes a first exhaust gas temperature sensor configured to measure a first temperature of exhaust gas produced by an engine at a first location in an exhaust system of the engine, a second exhaust gas temperature sensor configured to measure a second temperature of exhaust gas produced by the engine at a second location in the exhaust system, and a combustion control module configured to take the following actions when the first exhaust gas temperature is less than a first predetermined temperature: select at least one of a target boost pressure of the engine, a target exhaust gas recirculated (EGR) flow rate of the engine, and a target fuel injection parameter of the engine from a first set of target values when the second exhaust gas temperature is less than or equal to a second predetermined temperature; and select the at least one of the target boost pressure, the target EGR flow rate, and the target fuel injection parameter from a second set of target values when the second exhaust gas temperature is greater than the second predetermined temperature, where the second set of target values is different than the first set of target values.

In one example, the combustion control module is configured to select the target boost pressure from the first set of target values when the first exhaust gas temperature is less than the first predetermined temperature and the second exhaust gas temperature is less than or equal to the second predetermined temperature, the combustion control module is configured to select the target boost pressure from the second set of target values when the first exhaust gas temperature is less than the first predetermined temperature and the second exhaust gas temperature is greater than the second predetermined temperature, and for the same engine speed and the same engine load, the target boost pressure in the first set of target values is greater than the target boost pressure in the second set of target values.

In one example, the combustion control module is configured to select the target EGR flow rate from the first set of target values when the first exhaust gas temperature is less than the first predetermined temperature and the second exhaust gas temperature is less than or equal to the second predetermined temperature, the combustion control module is configured to select the target EGR flow rate from the second set of target values when the first exhaust gas temperature is less than the first predetermined temperature and the second exhaust gas temperature is greater than the second predetermined temperature, and for the same engine speed and the same engine load, the target EGR flow rate in the first set of target values is less than the target EGR flow rate in the second set of target values.

In one example, the combustion control module is configured to select the target fuel injection parameter from the first set of target values when the first exhaust gas temperature is less than the first predetermined temperature and the second exhaust gas temperature is less than or equal to the second predetermined temperature, the combustion control module is configured to select the target fuel injection parameter from the second set of target values when the first exhaust gas temperature is less than the first predetermined temperature and the second exhaust gas temperature is greater than the second predetermined temperature, the target fuel injection parameter includes a target injection quantity, the target injection quantity in the first set of target values has a first variability, and the target injection quantity in the second set of target values has a second variability that is greater than the first variability.

In one example, the first exhaust gas temperature sensor is located at an inlet of a selective catalytic reduction (SCR) catalyst in the exhaust system, the second exhaust gas temperature sensor is located at an inlet of a diesel oxidation catalyst in the exhaust system, and the second predetermined temperature is greater than the first predetermined temperature.

A third system according to the present disclosure includes an exhaust gas temperature sensor configured to measure a temperature of exhaust gas produced by an engine, and a fuel control module configured to adjust a target number of fuel injections for a cylinder of the engine during each combustion cycle of the engine to a first number when the exhaust gas temperature is less than or equal to a predetermined temperature, where the first number is an integer greater than seven.

In one example, the third system further includes a boost error module configured to determine a boost error of the engine, where the boost error is a difference between a target boost pressure of the engine and a current boost pressure of the engine, and where, when the exhaust gas temperature is less than or equal to the predetermined temperature, the fuel control module is configured to: adjust the target number of fuel injections to the first number when the boost error is less than or equal to a predetermined value; and adjust the target number of fuel injections to a second number when the boost error is greater than the predetermined value, where each of the first and second numbers is an integer greater than seven.

In one example, the second number is different than the first number.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
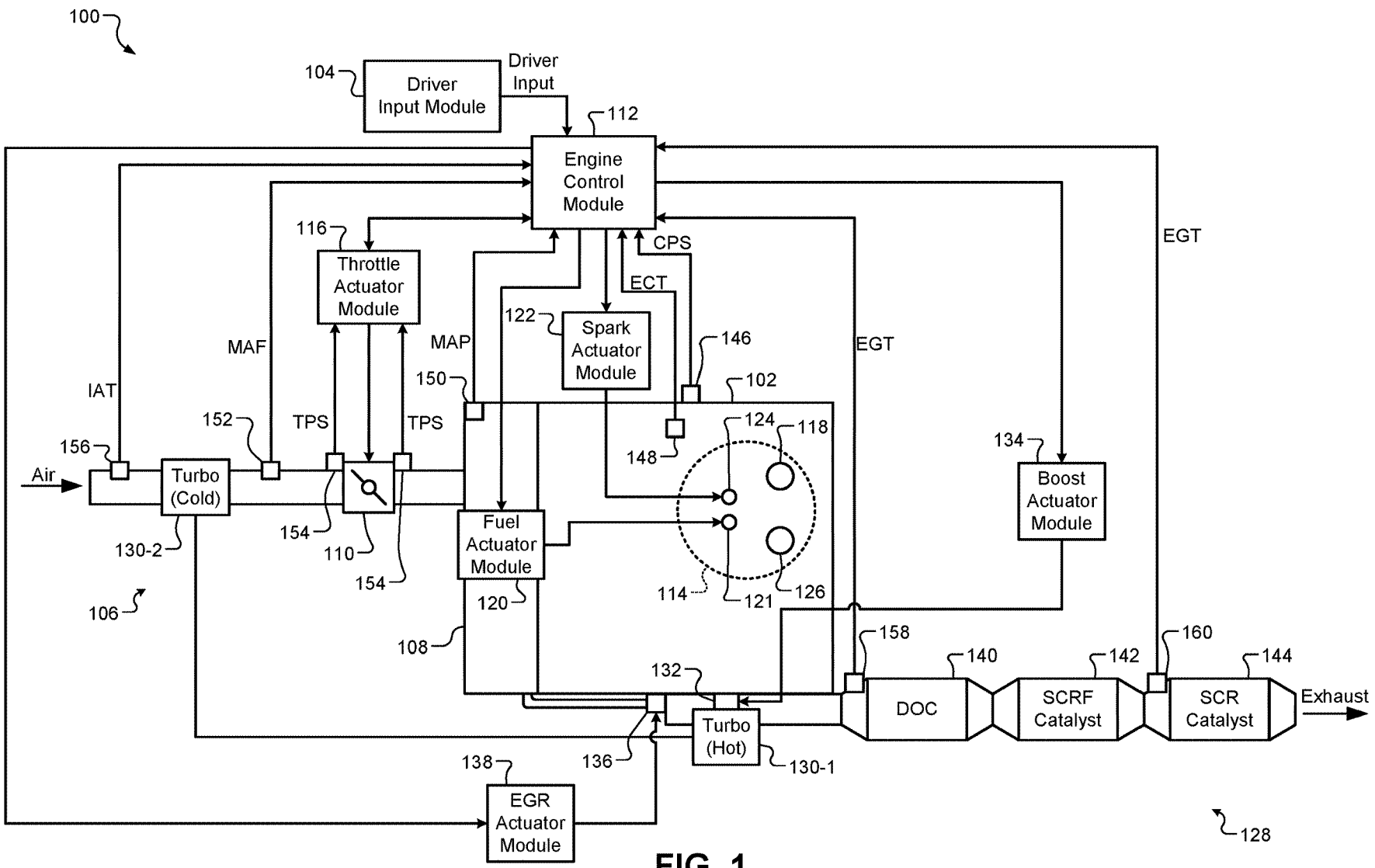
FIG. 1 is a functional block diagram of an example engine system according to the principles of the present disclosure.

A system and method according to the present disclosure accelerates engine warmup and reduces emissions during engine warmup by identifying various phases of engine warmup and employing a unique engine control strategy during each phase of engine warmup. The system and method identifies which phase of engine warmup is taking place based on an exhaust gas temperature measured at one or more locations in an aftertreatment system of the engine. The engine control strategy employed optimizes a tradeoff between reducing hydrocarbon emissions and reducing nitrogen oxide emissions while increasing the robustness of the aftertreatment system to rapid changes in exhaust gas temperature. The engine control strategy employed may also reduce carbon dioxide emissions during engine warmup.

In one example, the system and method also identifies whether the engine is completing a dynamic maneuver and, if so, uses a unique engine control strategy for the dynamic maneuver and the engine warmup phase. The system and method identifies whether the engine is completing a dynamic maneuver based on a boost pressure measured in an intake manifold of the engine. The engine control strategy used during the dynamic maneuver increases the robustness of the engine to misfire and hydrocarbon or smoke deterioration.

The system and method uses a unique engine control strategy for each phase of engine warmup and/or during a dynamic maneuver by selecting target combustion control parameters from a unique set of target values based on engine speed and/or engine load. In one example, the system and method selects the target combustion control parameters from a first set of target values when a diesel oxidation catalyst in the aftertreatment system is not yet efficient and the engine is not completing a dynamic maneuver. In addition, the system and method selects the target combustion control parameters from a second set of target values when the diesel oxidation catalyst is not yet efficient and the engine is completing a dynamic maneuver. Further, the system and method selects the target combustion control parameters from a third set of target values when the diesel oxidation catalyst is efficient and the engine is not completing a dynamic maneuver. Moreover, the system and method selects the target combustion control parameters from a fourth set of target values when the diesel oxidation catalyst is efficient and the engine is completing a dynamic maneuver.

The system and method determines whether the diesel oxidation catalyst is efficient based on an exhaust gas temperature measured in or near the diesel oxidation catalyst, such as at the inlet thereof. The target combustion parameters include a target boost pressure, a target EGR flow rate (or percentage), and target fuel injection parameters. The target fuel injection parameters include a target injection quantity, a target injection timing, and/or a target number of injections.

In one example, the system and method increases the number of fuel injections per cylinder for each engine cycle during engine warmup relative to the number of fuel injections per cylinder for each engine cycle during normal engine operation. During engine warmup, the system and method commands at least eight fuel injections, including two pilot injections, one main injection, and at least five after injections (or post injections) for each cylinder during each engine cycle. Increasing the number of fuel injections yields less quantity of fuel per injection, which reduces oil dilution and smoke.

Referring now to FIG. 1, an engine system 100 includes an engine 102. The engine 102 combusts an air/fuel mixture to produce drive torque for a vehicle based on driver input from a driver input module 104. Air is drawn into the engine 102 through an intake system 106. Air flow through the intake system 106 may be referred to as intake air flow. The intake system 106 may include an intake manifold 108 and a throttle valve 110. The throttle valve 110 may include a butterfly valve having a rotatable blade. An engine control module (ECM) 112 controls a throttle actuator module 116, which regulates opening of the throttle valve 110 to control the amount of air drawn into the intake manifold 108.

Air from the intake manifold 108 is drawn into cylinders of the engine 102. While the engine 102 may include multiple cylinders, for illustration purposes a single representative cylinder 114 is shown. For example only, the engine 102 may include 2, 3, 4, 5, 6, 8, 10, and/or 12 cylinders arranged in various configurations such as an inline configuration or a V configuration. The ECM 112 may deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 114. Therefore, two crankshaft revolutions are necessary for the cylinder 114 to experience all four of the strokes.

During the intake stroke, air from the intake manifold 108 is drawn into the cylinder 114 through an intake valve 118. The ECM 112 controls a fuel actuator module 120, which regulates fuel injection in the engine 102 by adjusting the opening duration and timing of a fuel injector 121. Fuel may be injected into the intake manifold 108 at a central location or at multiple locations, such as near the intake valve 118 of each of the cylinders. In various implementations, fuel may be injected directly into the cylinders or into mixing chambers associated with the cylinders. The fuel actuator module 120 may halt injection of fuel to cylinders that are deactivated.

The injected fuel mixes with air and creates an air/fuel mixture in the cylinder 114. During the compression stroke, a piston (not shown) within the cylinder 114 compresses the air/fuel mixture. The engine 102 may be a compression-ignition engine, in which case compression in the cylinder 114 ignites the air/fuel mixture. Alternatively, the engine 102 may be a spark-ignition engine, in which case a spark actuator module 122 energizes a spark plug 124 in the cylinder 114 based on a signal from the ECM 112, which ignites the air/fuel mixture. The timing of the spark may be specified relative to the time when the piston is at its topmost position, referred to as top dead center (TDC).

The spark actuator module 122 may be controlled by a timing signal specifying how far before or after TDC to generate the spark. Because piston position is directly related to crankshaft rotation, operation of the spark actuator module 122 may be synchronized with crankshaft angle. In various implementations, the spark actuator module 122 may halt provision of spark to deactivated cylinders.

Generating the spark may be referred to as a firing event. The spark actuator module 122 may have the ability to vary the timing of the spark for each firing event. The spark actuator module 122 may even be capable of varying the spark timing for a next firing event when the spark timing signal is changed between a last firing event and the next firing event. The spark actuator module 122 and the spark plug 124 may be omitted in implementations where the engine 102 is a compression-ignition engine.

During the combustion stroke, the combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 126. The byproducts of combustion are exhausted from the vehicle via an exhaust system 128.

The engine system 100 may include a boost device that provides pressurized air to the intake manifold 108. For example, FIG. 1 shows a turbocharger including a hot turbine 130-1 that is powered by hot exhaust gases flowing through the exhaust system 128. The turbocharger also includes a cold air compressor 130-2, driven by the turbine 130-1, which compresses air leading into the throttle valve 110. In various implementations, a supercharger (not shown), driven by the crankshaft, may compress air from the throttle valve 110 and deliver the compressed air to the intake manifold 108.

A wastegate 132 may allow exhaust to bypass the turbine 130-1, thereby reducing the boost (the amount of intake air compression) of the turbocharger. The ECM 112 may control the turbocharger via a boost actuator module 134. The boost actuator module 134 may modulate the boost of the turbocharger by controlling the position of the wastegate 132. In various implementations, multiple turbochargers may be controlled by the boost actuator module 134. The turbocharger may have variable geometry, which may be controlled by the boost actuator module 134.

An intercooler (not shown) may dissipate some of the heat contained in the compressed air charge, which is generated as the air is compressed. The compressed air charge may also have absorbed heat from components of the exhaust system 128. Although shown separated for purposes of illustration, the turbine 130-1 and the compressor 130-2 may be attached to each other, placing intake air in close proximity to hot exhaust.

The engine system 100 may include an exhaust gas recirculation (EGR) valve 136, which selectively redirects exhaust gas back to the intake manifold 108. The EGR valve 136 may be located upstream of the turbocharger's turbine 130-1. The EGR valve 136 may be controlled by an EGR actuator module 138.

The exhaust system 128 includes a diesel oxidation catalyst 140, a SCRF catalyst 142, and a SCR catalyst 144. The exhaust system 128 may be referred to as an aftertreatment system. The diesel oxidation catalyst 140 reduces carbon monoxide (CO), hydrocarbons (HC), and particulate matter (PM) emissions. The SCRF catalyst 142 reduces nitrogen oxide (NOx) emissions and traps soot (PM emissions). The SCR catalyst 144 simply reduces NOx emissions.

The position of the crankshaft may be measured using a crankshaft position (CKP) sensor 146. The ECM 112 may determine the speed of the crankshaft (i.e., the engine speed) based on the crankshaft position. The temperature of the engine coolant may be measured using an engine coolant temperature (ECT) sensor 148. The ECT sensor 148 may be located within the engine 102 or at other locations where the coolant is circulated, such as a radiator (not shown).

The pressure within the intake manifold 108 (i.e., the boost of the engine 102) may be measured using a manifold absolute pressure (MAP) sensor 150. In various implementations, engine vacuum, which is the difference between ambient air pressure and the pressure within the intake manifold 108, may be measured. The mass flow rate of air flowing into the intake manifold 108 may be measured using a mass air flow (MAF) sensor 152. In various implementations, the MAF sensor 152 may be located in a housing that also includes the throttle valve 110. The throttle actuator module 116 may monitor the position of the throttle valve 110 using one or more throttle position sensors (TPS) 154. The ambient temperature of air being drawn into the engine 102 may be measured using an intake air temperature (IAT) sensor 156.

The temperature of exhaust gas produced by the engine 102 may be measured at one or more locations in the exhaust system 128. The exhaust gas temperature at the inlet of the diesel oxidation catalyst 140 may be measured using an exhaust gas temperature (EGT) sensor 158. The exhaust gas temperature at the inlet of the SCR catalyst 144 may be measured using an EGT sensor 160.

The ECM 112 uses signals from the sensors to make control decisions for the engine system 100. In one example, the ECM 112 uses the signals from the EGT sensors 158, 160 to determine whether components of the exhaust system 128 are operating efficiently, and adjusts operating parameters of the engine 102 based on whether the components of the exhaust system 128 are operating efficiently. The engine operating parameters adjusted by the ECM 112 include a target boost pressure of the engine 102, a target EGR flow rate of the engine 102, and a target fuel injection parameter of the engine 102.

Figure 2:
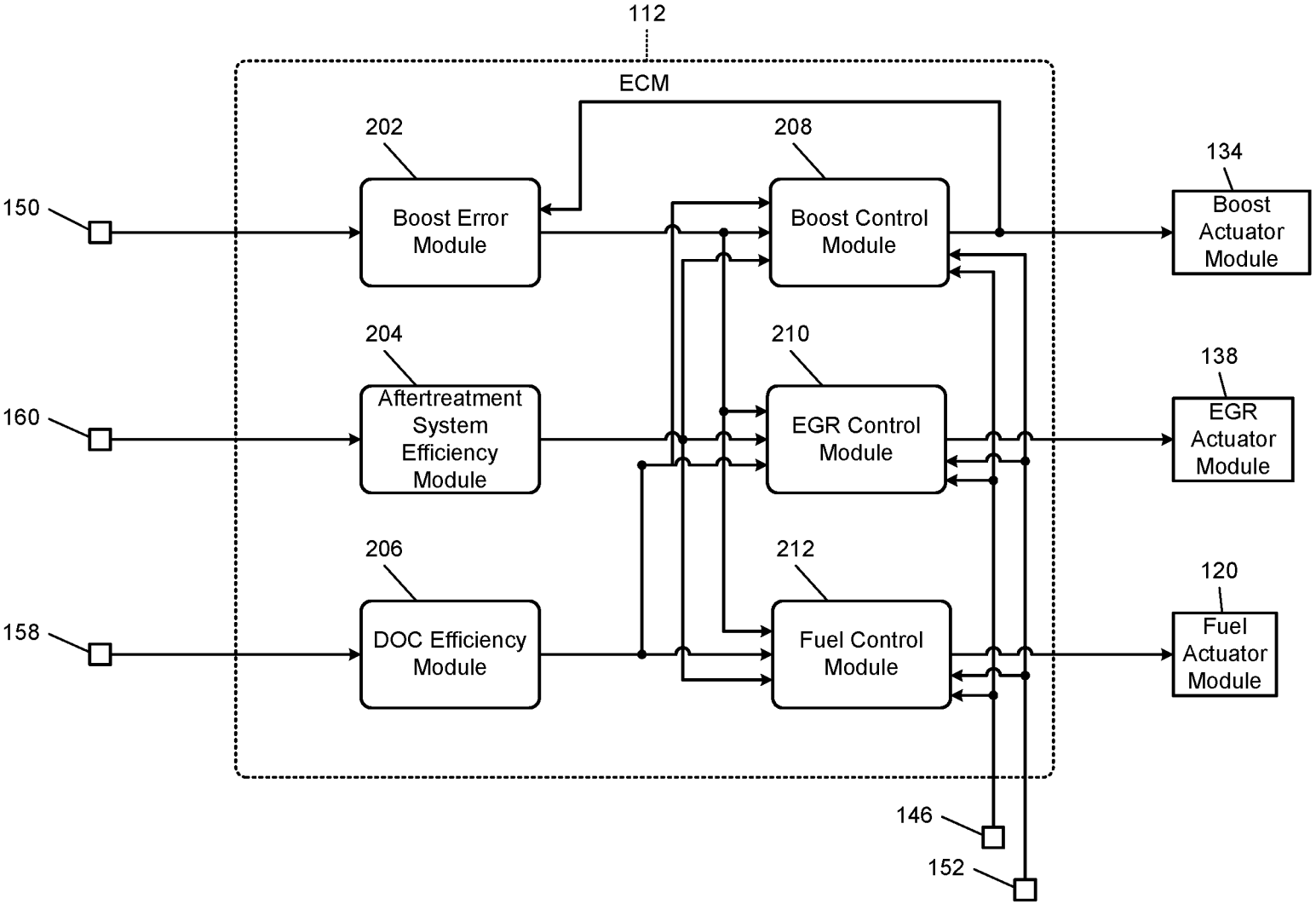
FIG. 2 is a functional block diagram of an example control system according to the principles of the present disclosure.

Referring now to FIG. 2, an example implementation of the ECM 112 includes a boost error module 202, an aftertreatment system efficiency module 204, a diesel oxidation catalyst (DOC) efficiency module 206, a boost control module 208, an EGR control module 210, and a fuel control module 212. The boost error module 202 determines a boost error of the engine 102. The boost error of the engine 102 is the difference between a target boost pressure of the engine 102 and a current boost pressure of the engine 102. The boost error module 202 receives the current boost pressure of the engine 102 (i.e., the pressure in the intake manifold 108) from the MAP sensor 150. The boost error module 202 receives the target boost pressure of the engine 102 from the boost control module 208.

The aftertreatment system efficiency module 204 determines whether the aftertreatment system (i.e., the exhaust system 128) is operating efficiently. In other words, the aftertreatment system efficiency module 204 determines whether the aftertreatment system is reducing emissions at a normal rate. The aftertreatment system operates efficiently when the components of the aftertreatment system are at their normal operating temperatures. Thus, when the engine 102 is initially started after the engine 102 has been off for an extended period (e.g., hours), the aftertreatment system does not operate efficiently. However, after the exhaust gas from engine 102 has warmed up the components of the aftertreatment system, the aftertreatment system operates efficiently.

The aftertreatment system efficiency module 204 may determine that the aftertreatment system is operating efficiently when the exhaust gas temperature at one or more locations in the aftertreatment system has reached a certain temperature. In one example, the aftertreatment system efficiency module 204 determines that the aftertreatment system is operating efficiently when the exhaust gas temperature at the inlet of the SCR catalyst 144 is greater than a first predetermined temperature (e.g., a temperature within a range from 110 degrees Celsius (° C.) to 120° C.). The aftertreatment system efficiency module 204 receives the exhaust gas temperature at the inlet of the SCR catalyst 144 from the EGT sensor 160.

The DOC efficiency module 206 determines whether the diesel oxidation catalyst 140 is operating efficiently. In other words, the DOC efficiency module 206 determines whether the diesel oxidation catalyst 140 is reducing CO, HC and PM emissions at a normal rate. The DOC efficiency module 206 may determine that the diesel oxidation catalyst 140 is operating efficiently when the exhaust gas temperature at one or more locations in or near the diesel oxidation catalyst 140 has reached a certain temperature. In one example, the DOC efficiency module 206 determines that the diesel oxidation catalyst 140 is operating efficiently when the exhaust gas temperature at the inlet of the diesel oxidation catalyst 140 is greater than a second predetermined temperature (e.g., a temperature within a range from 170° C. to 180° C.). The DOC efficiency module 206 receives the exhaust gas temperature at the inlet of the diesel oxidation catalyst 140 from the EGT sensor 158.

The boost control module 208, the EGR control module 210, and the fuel control module 212 control operating parameters of the engine 102 that influence the combustion performance of the engine 102. Thus, the boost control module 208, the EGR control module 210, and the fuel control module 212 may be individually or collectively referred to as a combustion control module. The boost control module 208 controls the boost pressure of the engine 102. The boost control module 208 accomplishes this by generating the target boost pressure and outputting the target boost pressure to the boost actuator module 134. In turn, the boost actuator module 134 controls the position of the wastegate 132 to achieve the target boost pressure.

The EGR control module 210 controls the rate of exhaust gas flow through the EGR valve 136, which may be referred to as the EGR flow rate of the engine 102. The boost control module 208 accomplishes this by generating a target EGR flow rate of the engine 102 and outputting the target EGR flow rate to the EGR actuator module 138. In turn, the EGR actuator module 138 controls the position of the EGR valve 136 to achieve the EGR flow rate.

The fuel control module 212 controls fuel injection in the engine 102. The fuel control module 212 accomplishes this by generating one or more target fuel injection parameters and outputting the target fuel injection parameters to the fuel actuator module 120. In turn, the fuel actuator module 120 controls the opening duration and timing of the fuel injector 121 to achieve the target fuel injection parameters. The fuel injection parameters may include a target fuel injection quantity, a target fuel injection timing, and/or a target number of fuel injections for each cylinder of the engine 102 during each cycle of the engine 102. The engine 102 completes one cycle when all of the cylinders of the engine complete all four of the strokes discussed above (i.e., the intake stroke, the compression stroke, the combustion stroke, and the exhaust stroke).

Figure 3:
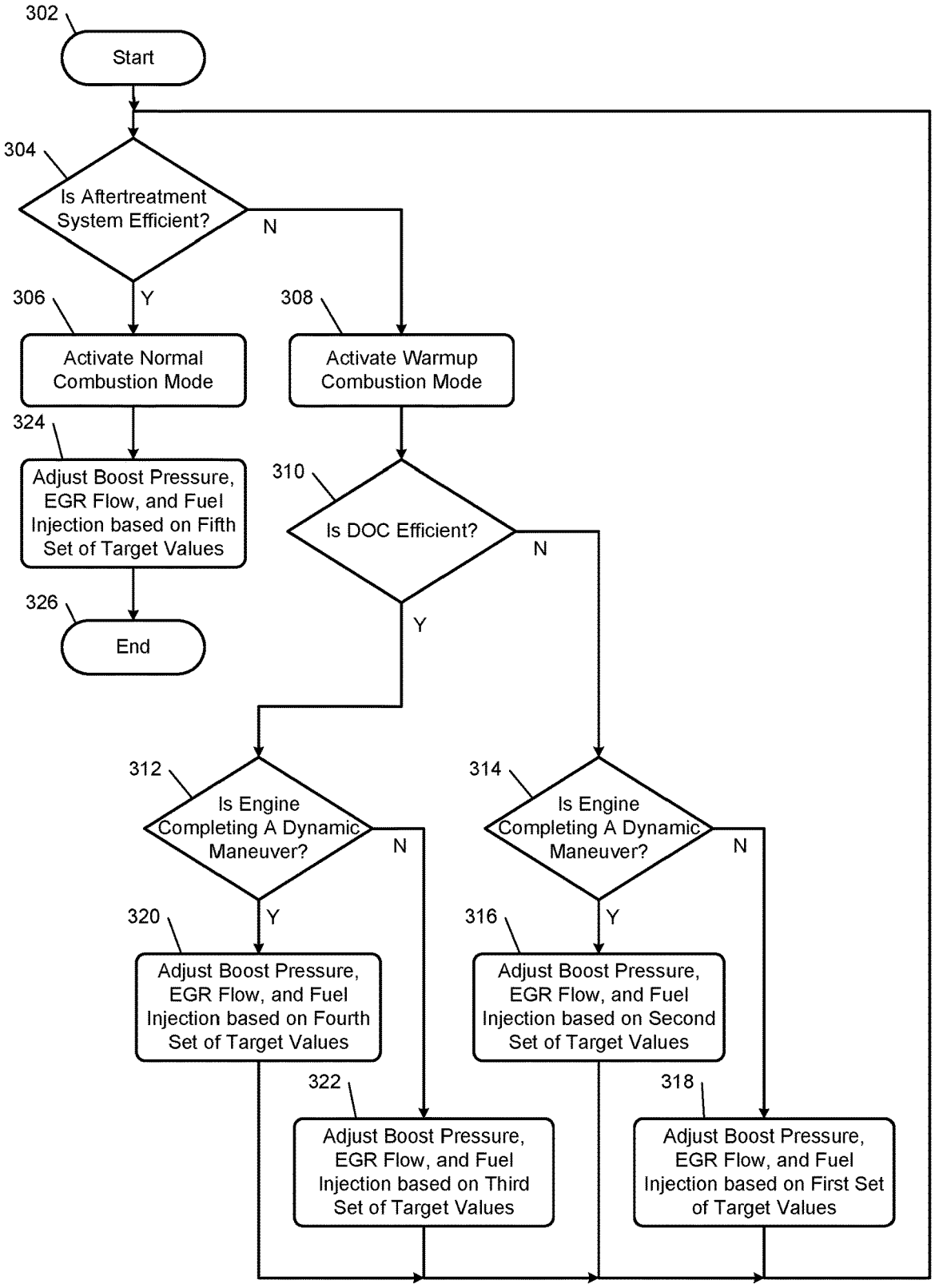
FIG. 3 is a flowchart illustrating an example method according to the principles of the present disclosure.

Referring now to FIG. 3, an example method of controlling the operating parameters of the engine 102 during engine warm-up begins at 302. The method of FIG. 3 may be performed when the engine 102 is started. The method is described in the context of the modules of FIG. 2. However, the particular modules that perform the steps of the method may be different than the modules mentioned below and/or one or more steps of the method may be implemented apart from the modules of FIG. 2.

At 304, the aftertreatment system efficiency module 204 determines whether the aftertreatment system (i.e., the exhaust system 128) is efficient. If the aftertreatment system is efficient, the method continues at 306. Otherwise, the method continues at 308. As discussed above, the aftertreatment system efficiency module 204 may determine that the aftertreatment system is efficient if the exhaust gas temperature at the inlet of the SCR catalyst 144 is greater than the first predetermined temperature. Otherwise, the aftertreatment system efficiency module 204 may determine that the aftertreatment system is not yet efficient.

At 308, the combustion control module (i.e., the boost control module 208, the EGR control module 210, and/or the fuel control module 212) activates a warmup combustion mode. The warmup combustion mode is an operating mode of the combustion control module that is activated during engine warmup. At 310, the DOC efficiency module 206 determines whether the diesel oxidation catalyst 140 is efficient. If the diesel oxidation catalyst 140 is efficient, the method continues at 312. Otherwise, the method continues at 314. As discussed above, the DOC efficiency module 206 may determine that the diesel oxidation catalyst 140 is efficient if the exhaust gas temperature at the inlet of the diesel oxidation catalyst 140 is greater than the first predetermined temperature. Otherwise, the DOC efficiency module 206 may determine that the diesel oxidation catalyst 140 is not yet efficient.

At 314, the combustion control module determines whether the engine 102 is completing a dynamic maneuver. If the engine 102 is completing a dynamic maneuver, the method continues at 316. Otherwise, the method continues at 318. The combustion control module may determine that the engine 102 is completing a dynamic maneuver when the boost error is greater than a predetermined value (e.g., a value within a range between 30 kilopascals (kPa) and 60 kPa). Otherwise, the combustion control module may determine that the engine 102 is not completing a dynamic maneuver. The combustion control module may receive the boost error from the boost error module 202.

At 318, the combustion control module adjusts a boost pressure of the engine 102, an EGR flow rate of the engine 102, and/or one or more fuel injection parameters of the engine 102 based on a first set of target values. In one example, at 318, the boost control module 208 selects a target boost pressure of the engine 102 from the first set of target values, the EGR control module 210 selects a target EGR flow rate of the engine 102 from the first set of target values, and the fuel control module 212 selects one or more target fuel injection parameters from the first set of target values. The boost control module 208, the EGR control module 210, and the fuel control module 212 may select the target boost pressure, the target EGR flow rate, and the target fuel injection parameter(s), respectively, from the first set of target values based on the speed of the engine 102 and/or the load on the engine 102. For example, the boost control module 208 may select the target boost pressure using a function or mapping that relates engine speed and engine load to a target boost pressure in the first set, the EGR control module 210 may select the target EGR flow rate using a function or mapping that relates engine speed and engine load to a target EGR flow rate in the first set, and the fuel control module 212 may select the target fuel injection parameter(s) using a function or mapping that relates engine speed and engine load to target fuel injection parameter(s) in the first set.

The boost control module 208, the EGR control module 210, and the fuel control module 212 may determine the speed of the engine 102 based on the crankshaft position from the CKP sensor 146 by, for example, determining the change in the crankshaft position with respect to time. Alternatively, the ECM 112 may include an engine speed module (not shown) that determines the speed of the engine 102 based on the measured crankshaft position and outputs the engine speed to the boost control module 208, the EGR control module 210, and the fuel control module 212. The boost control module 208, the EGR control module 210, and the fuel control module 212 may determine the load the engine 102 based on the rate of intake air flow from the MAF sensor 152 using, for example, a function and/or mapping that relates the rate of intake air flow to engine load. Alternatively, the ECM 112 may include an engine load module (not shown) that determines the load on the engine 102 based on the measured flow rate of intake air and outputs the engine load to the boost control module 208, the EGR control module 210, and the fuel control module 212.

The target boost pressure is a target value for the pressure within the intake manifold 108 of the engine 102. The target EGR flow rate is a target value for the rate of exhaust gas flow through the EGR valve 136 (EGR flow). The target EGR flow rate may be expressed as a EGR flow rate or as a ratio or percentage of the EGR flow relative to the total amount of intake air flow and EGR flow entering the intake manifold.

The target fuel injection parameters may include a target fuel injection quantity, a target fuel injection timing, and/or a target number of injections. The target fuel injection quantity may include a target value for the total amount of fuel to be injection in each cylinder of the engine 102 during each engine cycle and/or a target value for the amount of fuel to be injected during each injection. The target fuel injection timing may be a target value for a crank angle of the engine 102 at which fuel injection into each cylinder of the engine 102 is to start. The target number of injections is a target value for the number of fuel injections into each cylinder of the engine 102 during each engine cycle.

At 316, the combustion control module adjusts the boost pressure of the engine 102, the EGR flow rate of the engine 102, and/or the fuel injection parameter(s) of the engine 102 based on a second set of target values. In one example, at 316, the boost control module 208 selects the target boost pressure of the engine 102 from the second set of target values, the EGR control module 210 selects the target EGR flow rate of the engine 102 from the second set of target values, and the fuel control module 212 selects one or more of the target fuel injection parameters from the second set of target values. The boost control module 208, the EGR control module 210, and the fuel control module 212 may select the target boost pressure, the target EGR flow rate, and the target fuel injection parameter(s), respectively, from the second set of target values based on the speed of the engine 102 and/or the load on the engine 102. For example, the boost control module 208 may select the target boost pressure using a function or mapping that relates engine speed and engine load to a target boost pressure in the second set, the EGR control module 210 may select the target EGR flow rate using a function or mapping that relates engine speed and engine load to a target EGR flow rate in the second set, and the fuel control module 212 may select the target fuel injection parameter(s) using a function or mapping that relates engine speed and engine load to target fuel injection parameter(s) in the second set.

The second set of target values is different than the first set of target values. For example, the target number of fuel injections and/or the target fuel injection timing in the second set of target values may be different than the target number of fuel injections and/or the target fuel injection timing, respectively, in the first set of target values. In one example, the target number of fuel injections in the first set of target values is a first number (e.g., 10), and the target number of fuel injections in the second set of target values is a second number (e.g., 8) that is less than the first number. In another example, the target fuel injection timing in the second set of target values may be advanced by a predetermined amount (e.g., 5 crank angle degrees) relative to the target fuel injection timing in the first set of target values.

At 312, the combustion control module determines whether the engine 102 is completing a dynamic maneuver. If the engine 102 is completing a dynamic maneuver, the method continues at 320. Otherwise, the method continues at 322.

At 322, the combustion control module adjusts the boost pressure of the engine 102, the EGR flow rate of the engine 102, and/or the fuel injection parameter(s) of the engine 102 based on a third set of target values. In one example, at 322, the boost control module 208 selects the target boost pressure of the engine 102 from the third set of target values, the EGR control module 210 selects the target EGR flow rate of the engine 102 from the third set of target values, and the fuel control module 212 selects one or more of the target fuel injection parameters from the third set of target values. The boost control module 208, the EGR control module 210, and the fuel control module 212 may select the target boost pressure, the target EGR flow rate, and the target fuel injection parameter(s), respectively, from the third set of target values based on the speed of the engine 102 and/or the load on the engine 102. For example, the boost control module 208 may select the target boost pressure using a function or mapping that relates engine speed and engine load to a target boost pressure in the third set, the EGR control module 210 may select the target EGR flow rate using a function or mapping that relates engine speed and engine load to a target EGR flow rate in the third set, and the fuel control module 212 may select the target fuel injection parameter(s) using a function or mapping that relates engine speed and engine load to target fuel injection parameter(s) in the third set.

The third set of target values is different than the first set of target values. For example, for the same engine speed and the same engine load, the target boost pressure in the first set of target values may be greater than the target boost pressure in the third set of target values by a predetermined percentage (e.g., a percentage within a range from 50 percent (%) to 75%). In another example, for the same engine speed and the same engine load, the EGR flow rate in the first set of target values may have a first maximum value (e.g., 10% EGR flow out of total EGR and intake air flow), and the EGR flow rate in the second set of target values may have a second maximum value (e.g., 20% EGR flow out of total EGR and intake air flow). The second maximum value may be greater than the first maximum value. In yet another example, for the same engine speed and the same engine load, the target total amount of fuel injection into each cylinder of the engine 102 during each engine cycle may be greater in the first set than in the third set.

At 320, the combustion control module adjusts the boost pressure of the engine 102, the EGR flow rate of the engine 102, and/or the fuel injection parameter(s) of the engine 102 based on a fourth set of target values. In one example, at 320, the boost control module 208 selects the target boost pressure of the engine 102 from the fourth set of target values, the EGR control module 210 selects the target EGR flow rate of the engine 102 from the fourth set of target values, and the fuel control module 212 selects one or more of the target fuel injection parameters from the fourth set of target values. The boost control module 208, the EGR control module 210, and the fuel control module 212 may select the target boost pressure, the target EGR flow rate, and the target fuel injection parameter(s), respectively, from the fourth set of target values based on the speed of the engine 102 and/or the load on the engine 102. For example, the boost control module 208 may select the target boost pressure using a function or mapping that relates engine speed and engine load to a target boost pressure in the fourth set, the EGR control module 210 may select the target EGR flow rate using a function or mapping that relates engine speed and engine load to a target EGR flow rate in the fourth set, and the fuel control module 212 may select the target fuel injection parameter(s) using a function or mapping that relates engine speed and engine load to target fuel injection parameter(s) in the fourth set.

The fourth set of target values is different than the third set of target values. For example, the target number of fuel injections and/or the target fuel injection timing in the fourth set of target values may be different than the target number of fuel injections and/or the target fuel injection timing, respectively, in the third set of target values. In one example, the target number of fuel injections in the third set of target values is a first number (e.g., 10), and the target number of fuel injections in the fourth set of target values is a second number (e.g., 8) that is less than the first number. In another example, the target fuel injection timing in the fourth set of target values may be advanced by a predetermined amount (e.g., 5 crank angle degrees) relative to the target fuel injection timing in the third set of target values.

In addition, the fourth set of target values is different than the second set of target values. For example, for the same engine speed and the same engine load, the target boost pressure in the second set of target values may be greater than the target boost pressure in the fourth set of target values by a predetermined percentage (e.g., a percentage within a range from 50 percent (%) to 75%). In another example, for the same engine speed and the same engine load, the EGR flow rate in the second set of target values may have a first maximum value (e.g., 10% EGR flow out of total EGR and intake air flow), and the EGR flow rate in the fourth set of target values may have a second maximum value (e.g., 20% EGR flow out of total EGR and intake air flow). The second maximum value may be greater than the first maximum value. In yet another example, for the same engine speed and the same engine load, the target total amount of fuel injection into each cylinder of the engine 102 during each engine cycle may be greater in the second set than in the fourth set.

Further, each of the first, second, third, and fourth sets of target values may specify a target number of fuel injections that is greater than seven injections for each cylinder during each engine cycle, and the variability between the target quantities for the fuel injections may be different in the first and second sets relative to the third and fourth sets. For example, the target fuel injection quantities in the first and second sets of target values may have a first variability, and the target injection quantities in the third and fourth sets of target values may have a second variability that is greater than the first variability. In other words, for the third and fourth sets of target values, there may be greater variation in the target quantities of fuel injections that take place in a single cylinder during a single engine cycle relative to the variation in the corresponding target quantities in the first and third sets of target values.

At 306, the combustion control module (i.e., the boost control module 208, the EGR control module 210, and/or the fuel control module 212) activates a normal combustion mode. The normal combustion mode is an operating mode of the combustion control module that is activated during normal operation of the engine 102. At 324, the combustion control module adjusts the boost pressure of the engine 102, the EGR flow rate of the engine 102, and/or the fuel injection parameter(s) of the engine 102 based on a fifth set of target values. In one example, at 324, the boost control module 208 selects the target boost pressure of the engine 102 from the fifth set of target values, the EGR control module 210 selects the target EGR flow rate of the engine 102 from the fifth set of target values, and the fuel control module 212 selects one or more of the target fuel injection parameters from the fifth set of target values. The boost control module 208, the EGR control module 210, and the fuel control module 212 may select the target boost pressure, the target EGR flow rate, and the target fuel injection parameter(s), respectively, from the fifth set of target values based on the speed of the engine 102 and/or the load on the engine 102. For example, the boost control module 208 may select the target boost pressure using a function or mapping that relates engine speed and engine load to a target boost pressure in the fifth set, the EGR control module 210 may select the target EGR flow rate using a function or mapping that relates engine speed and engine load to a target EGR flow rate in the fifth set, and the fuel control module 212 may select the target fuel injection parameter(s) using a function or mapping that relates engine speed and engine load to target fuel injection parameter(s) in the fifth set.

The fifth set of target values is different than each of the first, second, third, and fourth sets of target values. For example, target number of fuel injections in the fifth set of target values may be less than the target number of fuel injections in each of the first, second, third, and fourth sets of target values. The method ends at 326.

When one set of target values is referred to herein as being different than another set of target values, the one set includes at least one target value that is different than the corresponding target value in the other set for a given engine speed and a given engine load. However, some of the target values in the one set may be the same as some of the target values in the other set that correspond to a different engine speed and/or a different engine load. In addition, some, but not all, of the target values in the one set may be the same as some of the target values in the other set that correspond to the same engine speed and the same engine load.

Figure 4:
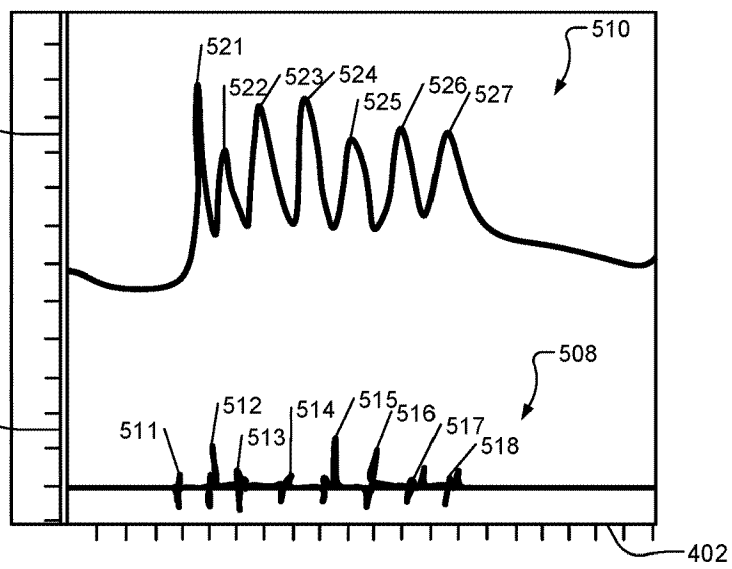
FIGS. 4-7 are graphs illustrating example injector command and adiabatic heat release rate signals according to the principles of the present disclosure.

Referring now to FIGS. 4-7, example injector command signals and adiabatic heat release rate signals are plotted with respect to an x-axis 402 that represents crank angle in degrees, a first y-axis 404 that represents injector command in volts, and a second y-axis 406 that represents heat release rate in kilojoules per cubic meter times degree (kJ/m$^3$*deg). FIG. 4 shows a first injector command signal 408 and a first adiabatic heat release rate signal 410 for one cylinder of the engine 102 during one engine cycle. The first injector command signal 408 and the first adiabatic heat release rate signal 410 indicate examples of target fuel injection parameters in the first set of target values. As discussed above, the fuel control module 212 may select the target fuel injection parameters from the first set of target values when the diesel oxidation catalyst 140 is not efficient and the engine 102 is not completing a dynamic maneuver.

Each pulse (or fluctuation) in the first injector command signal 408 represents a fuel injection pulse. The first injector command signal 408 includes ten pulses—a first pulse 411, a second pulse 412, a third pulse 413, a fourth pulse 414, a fifth pulse 415, a sixth pulse 416, a seventh pulse 417, an eighth pulse 418, a ninth pulse 419, and a tenth pulse 420. Thus, the first injector command signal 408 indicates that the target number of fuel injections in the first set of target values may be ten. The first and second pulses 411 and 412 may be referred to as pilot injections. The third fuel pulse 413 may be referred to as a main injection. The fourth through tenth pulses 414-420 may be referred to as after injections or post injections.

The first adiabatic heat release rate signal 410 has ten spikes—a first spike 421, a second spike 422, a third spike 423, a fourth spike 424, a fifth spike 425, a sixth spike 426, a seventh spike 427, an eighth spike 428, a ninth spike 429, and a tenth spike 430. The magnitude of each spike in the first adiabatic heat release rate signal 410 indicates the quantity of fuel injected during a corresponding one of the pulse 411-420 in the first injector command signal 408. For example, the magnitude of the first spike 421 in the first adiabatic heat release rate signal 410 indicates the quantity of fuel injected during the first pulse 411 in the first injector command signal 408, the magnitude of the second spike 422 in the first adiabatic heat release rate signal 410 indicates the quantity of fuel injected during the second pulse 412 in the first injector command signal 408, and so on. In one example, the target amount of fuel injection during each of the pilot injections is within a range from 2 to 2.5 millimeters cubed (mm$^3$), the target amount of fuel injection during the main injection and each of the first six after injections is within a range from 5 to 6 mm$^3$, and the target amount of fuel injection during the last after injection is 2 mm$^3$. Notably, the main injection and the first six after injections are all balanced. In other words, there is relatively small variation between the magnitudes of the spikes corresponding to the main injection and the first six after injections, which reflects that there is small variation in the target amount of fuel injection for these seven fuel injections.

Figure 5:
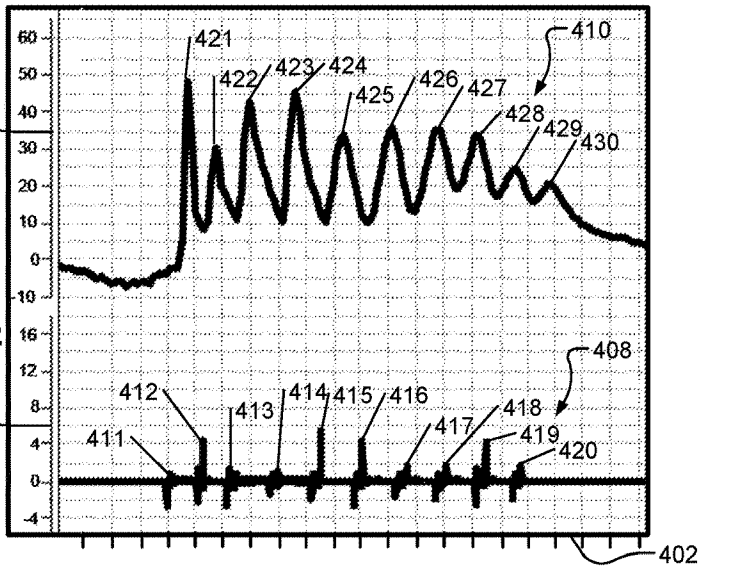

FIG. 5 shows a second injector command signal 508 and a second adiabatic heat release rate signal 510 for one cylinder of the engine 102 during one engine cycle. The first injector command signal 508 and the first adiabatic heat release rate signal 510 indicate examples of target fuel injection parameters in the second set of target values. As discussed above, the fuel control module 212 may select the target fuel injection parameters from the first set of target values when the diesel oxidation catalyst 140 is not efficient and the engine 102 is completing a dynamic maneuver.

Each pulse (or fluctuation) in the second injector command signal 508 represents a fuel injection pulse. The second injector command signal 508 includes eight pulses—a first pulse 511, a second pulse 512, a third pulse 513, a fourth pulse 514, a fifth pulse 515, a sixth pulse 516, a seventh pulse 517, and an eighth pulse 518. Thus, the second injector command signal 508 indicates that the target number of fuel injections in the second set of target values may be eight. The first and second pulses 511 and 512 may be referred to as pilot injections. The third pulse 513 may be referred to as a main injection. The fourth through eighth pulses 514-518 may be referred to as after injections or post injections.

The second adiabatic heat release rate signal 510 has seven spikes—a first spike 521, a second spike 522, a third spike 523, a fourth spike 524, a fifth spike 525, a sixth spike 526, and a seventh spike 527. The magnitude of each spike in the second adiabatic heat release rate signal 510 indicates the quantity of fuel injected during a corresponding one or two of the pulse 511-518 in the second injector command signal 508. For example, the magnitude of the first spike 521 in the second adiabatic heat release rate signal 510 indicates the quantity of fuel injected during the first pulse 511 in the second injector command signal 508, the magnitude of the second spike 522 in the second adiabatic heat release rate signal 510 indicates the quantity of fuel injected during the second pulse 512 in the second injector command signal 508, and so on. In one example, the target amount of fuel injection during each of the pilot injections is within a range from 2 to 2.5 mm$^3$, the target amount of fuel injection during the main injection and each of the first four after injections is within a range from 5 to 6 mm$^3$, and the target amount of fuel injection during the last after injection is 2 mm$^3$. Notably, the main injection and the first four after injections are all balanced. In other words, there is relatively small variation between the magnitudes of the spikes corresponding to the main injection and the first four after injections, which reflects that there is small variation in the target amount of fuel injection for these five fuel injections.

Figure 6:
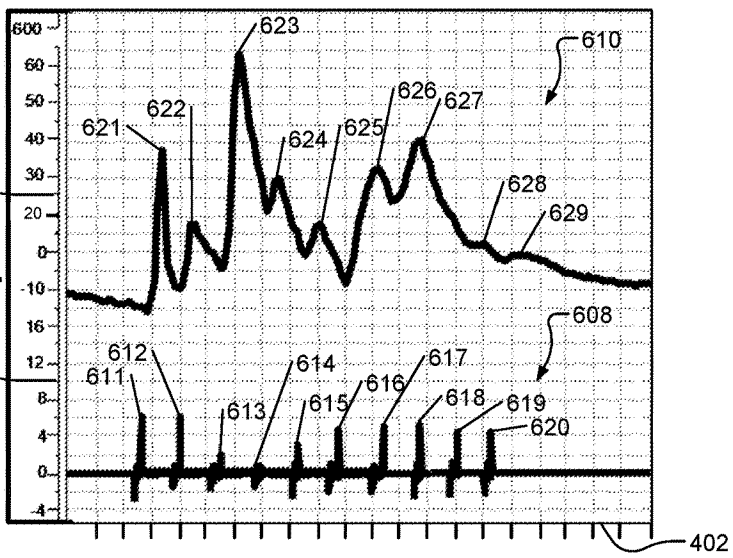

FIG. 6 shows a third injector command signal 608 and a third adiabatic heat release rate signal 610 for one cylinder of the engine 102 during one engine cycle. The third injector command signal 608 and the third adiabatic heat release rate signal 610 indicate examples of target fuel injection parameters in the third set of target values. As discussed above, the fuel control module 212 may select the target fuel injection parameters from the third set of target values when the diesel oxidation catalyst 140 is efficient and the engine 102 is not completing a dynamic maneuver.

Each pulse (or fluctuation) in the third injector command signal 608 represents a fuel injection pulse. The third injector command signal 608 includes ten pulses—a first pulse 611, a second pulse 612, a third pulse 613, a fourth pulse 614, a fifth pulse 615, a sixth pulse 616, a seventh pulse 617, an eighth pulse 618, a ninth pulse 619, and a tenth pulse 620. Thus, the third injector command signal 608 indicates that the target number of fuel injections in the third set of target values may be ten. The first and second pulses 611 and 612 may be referred to as pilot injections. The third pulse 613 may be referred to as a main injection. The fourth through tenth pulses 614-620 may be referred to as after injections or post injections.

The third adiabatic heat release rate signal 610 has nine spikes—a first spike 621, a second spike 622, a third spike 623, a fourth spike 624, a fifth spike 625, a sixth spike 626, a seventh spike 627, an eighth spike 628, and a ninth spike 629. The magnitude of each spike in the third adiabatic heat release rate signal 610 indicates the quantity of fuel injected during a corresponding one or two of the pulse 611-620 in the third injector command signal 608. For example, the magnitude the first spike 621 in the third adiabatic heat release rate signal 610 indicates the quantity of fuel injected during the first pulse 611 in the third injector command signal 608, the magnitude of the second spike 622 in the third adiabatic heat release rate signal 610 indicates the quantity of fuel injected during the second pulse 612 in the third injector command signal 608, and so on. In one example, the target amount of fuel injection during each of the pilot injections is 2 $mm^3$, the target amount of fuel injection during the main injection and each of the first six after injections is within a range from 5 to 10 $mm^3$, and the target amount of fuel injection during the last after injection is 2 $mm^3$. Notably, the main injection and the first six after injections are not all balanced. In other words, there is relatively high variation between the magnitudes of the spikes corresponding to the main injection and the first six after injections, which reflects that there is large variation in the target amount of fuel injection for these seven fuel injections.

Figure 7:
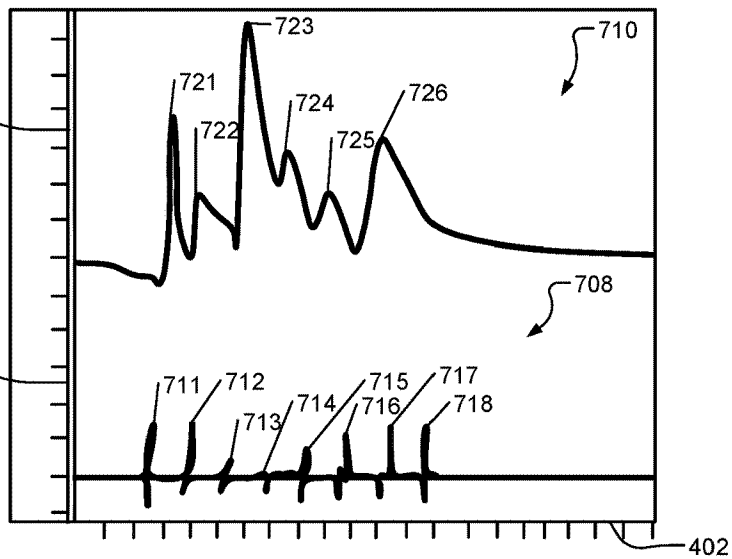

FIG. 7 shows a fourth injector command signal 708 and a fourth adiabatic heat release rate signal 710 for one cylinder of the engine 102 during one engine cycle. The fourth injector command signal 708 and the fourth adiabatic heat release rate signal 710 indicate examples of target fuel injection parameters in the fourth set of target values. As discussed above, the fuel control module 212 may select the target fuel injection parameters from the fourth set of target values when the diesel oxidation catalyst 140 is efficient and the engine 102 is completing a dynamic maneuver.

Each pulse (or fluctuation) in the fourth injector command signal 708 represents a fuel injection pulse. The fourth injector command signal 708 includes eight pulses—a first pulse 711, a second pulse 712, a third pulse 713, a fourth pulse 714, a fifth pulse 715, a sixth pulse 716, a seventh pulse 717, and an eighth pulse 718. Thus, the fourth injector command signal 708 indicates that the target number of fuel injections in the fourth set of target values may be eight. The first and second pulses 711 and 712 may be referred to as pilot injections. The third pulse 713 may be referred to as a main injection. The fourth through eight pulses 714-718 may be referred to as after injections or post injections.

The fourth adiabatic heat release rate signal 710 has six spikes—a first spike 721, a second spike 722, a third spike 723, a fourth spike 724, a fifth spike 725, and a sixth spike 726. The magnitude of each spike in the fourth adiabatic heat release rate signal 710 indicates the quantity of fuel injected during a corresponding one or two of the pulse 711-718 in the fourth injector command signal 708. For example, the first spike 721 in the fourth adiabatic heat release rate signal 710 indicates the quantity of fuel injected during the first pulse 711 in the fourth injector command signal 708, the second spike 722 in the fourth adiabatic heat release rate signal 710 indicates the quantity of fuel injected during the second pulse 712 in the fourth injector command signal 708, and so on. In one example, the target amount of fuel injection during each of the pilot injections is 2 $mm^3$, the target amount of fuel injection during the main injection and each of the first four after injections is within a range from 5 to 10 $mm^3$, and the target amount of fuel injection during the last after injection is 2 $mm^3$. Notably, the main injection and the first four after injections are not all balanced. In other words, there is relatively high variation between the magnitudes of the spikes corresponding to the main injection and the first four after injections, which reflects that there is large variation in the target amount of fuel injection for these five fuel injections.

The injector command signals and the adiabatic heat release rate signals shown in FIGS. 4-7 correspond to a six-cylinder, inline, direct injection, compression-ignition engine. In addition, the injector command signals and the adiabatic heat release rate signals shown in FIGS. 4-7 correspond to an engine speed of 1600 revolutions per minute (RPM) and an engine load (or brake mean effective pressure) of 5 bar. While the magnitudes of the spikes in the adiabatic heat release rate signals may be different for different engine applications and different engine speed/load set points, the shape (or variation) in the adiabatic heat release rate signals may be the same.

Figure 8:
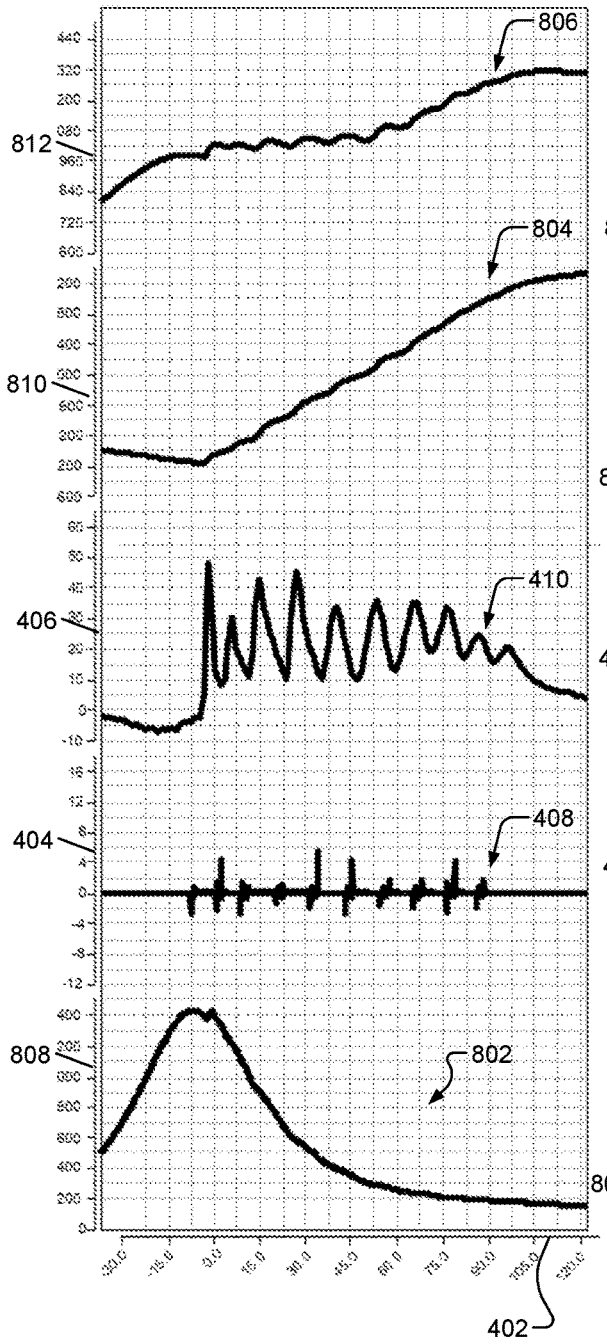
FIGS. 8 and 9 are graphs illustrating example engine operating parameter signals during an engine warmup according to the principles of the present disclosure.
Figure 9:
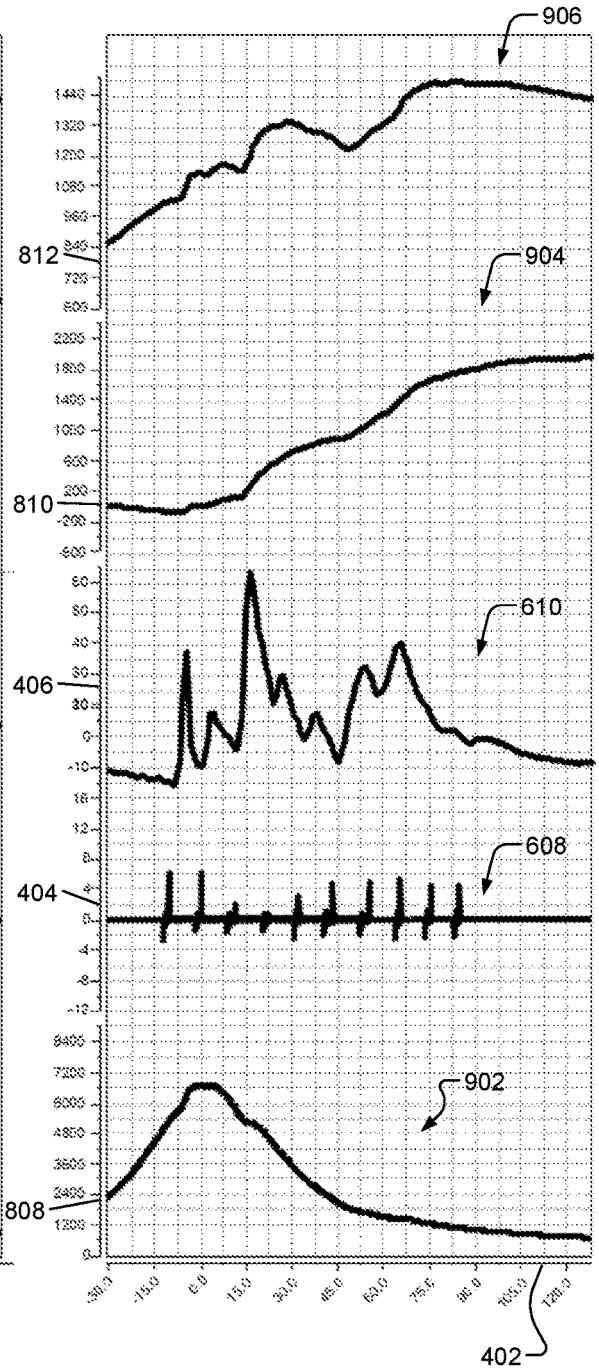

Referring now to FIGS. 8 and 9, the example injector command signals and adiabatic heat release rate signals of FIGS. 4 and 6 are shown along with corresponding example signals indicating an in-cylinder pressure, an integral of the adiabatic heat release rate, and an average in-cylinder temperature. FIG. 8 shows the injector command signal 408 of FIG. 4 and the adiabatic heat release rate signal 410 of FIG. 4, along with an in-cylinder pressure signal 802, an adiabatic heat release rate (AHRR) integral signal 804 and an in-cylinder average temperate signal 806. FIG. 9 shows the injector command signal 608 of FIG. 6 and the adiabatic heat release rate signal 610 of FIG. 6, along with an in-cylinder pressure signal 902, an AHRR integral signal 904 and an in-cylinder average temperate signal 906.

All of the signals are plotted with respect to the x-axis 402 that represents crank angle in degrees. As with FIGS. 4 and 6, the injector command signals 408, 608 are plotted with respect to the first y-axis 404 that represents injector command in volts, and the adiabatic heat release rate signals are plotted with respect to the second y-axis 406 that represents heat release rate in $kJ/m^3$*deg. The in-cylinder pressure signals 802, 902 are plotted with respect to a third y-axis 808 that represents pressure in kPa. The AHRR integral signals 804, 904 are plotted with respect to a fourth y-axis 810 that represents AHRR integral in kilojoules per cubic meter ($kJ/m^3$). The in-cylinder average temperature signals 806, 906 are plotted with respect to a fifth y-axis 812 that represents temperature in kelvin (K).

Figure 10:
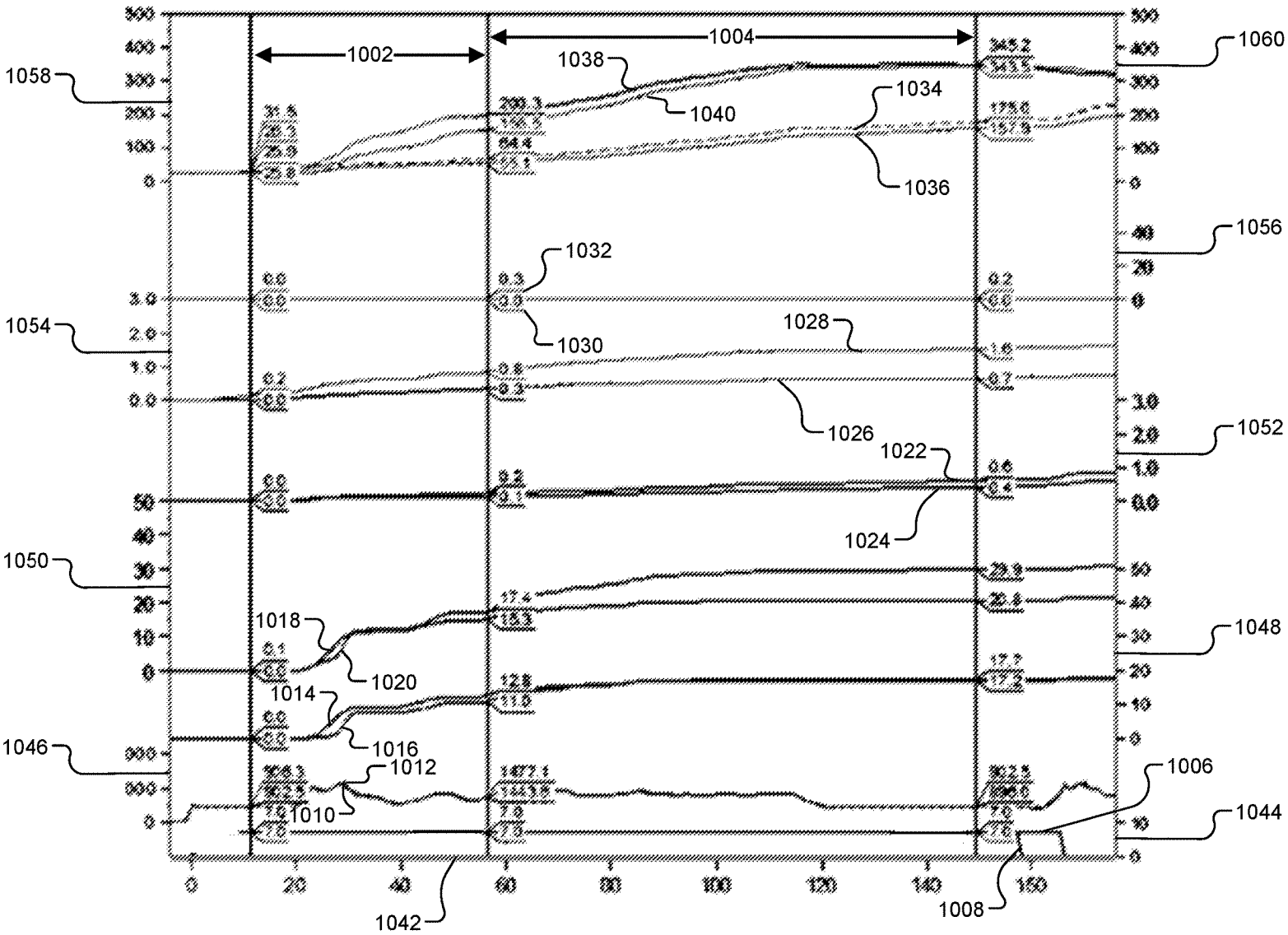
FIG. 10 is a graph illustrating example combustion mode signals, example engine speed signals, example emission level signals, and example exhaust gas temperature signals according to the principles of the present disclosure.

FIG. 10 shows examples of various engine operating parameter signals during a first portion 1002 of an engine warmup period when the diesel oxidation catalyst 140 is not yet efficient and during a second portion 1004 of the engine warmup period when the diesel oxidation catalyst 140 is efficient. The engine operating parameter signals include combustion mode signals 1006, 1008, engine speed signals 1010, 1012, NOx SCR out signals 1014, 1016, NOx/HC signals 1018, 1020, NOx engine out signals 1022, 1024, HC engine out signals 1026, 1028, ammonia (NH3) SCR out signals 1030, 1032, EGT SCR inlet signals 1034, 1036, and EGT SCRF inlet signals 1038, 1040.

The combustion mode signals 1006, 1008 indicate whether the warmup mode is activated. Each of the combustion mode signals 1006, 1008 indicates that the warmup mode is activated when its value is seven. The engine speed signals 1010, 1012 indicate the speed of the engine 102. The NOx SCR out signals 1014, 1016 indicate NOx levels at the outlet of the SCR catalyst 144. The NOx/HC signals 1018, 1020 indicate the total levels of NOx and HC in exhaust gas produced by the engine 102. The NOx engine out signals 1022, 1024 indicate the NOx levels at the outlet of the engine 102. The HC engine out signals 1026, 1028 indicate the HC levels at the outlet of the engine 102. The NH3 SCR out signals 1030, 1032 indicate the NH3 levels at the outlet of the SCR catalyst 144. The EGT SCR inlet signals 1034, 1036 indicate the EGT at the inlet of the SCR catalyst 144. The EGT SCRF inlet signals 1038, 1040 indicate the EGT at the inlet of the SCRF catalyst 142.

The combustion mode signal 1006, the engine speed signal 1010, the NOx SCR out signal 1014, the NOx/HC signal 1018, the NOx engine out signal 1022, the HC engine out signal 1026, the NH3 SCR out signal 1030, the EGT SCR inlet signal 1034, and the EGT SCRF inlet signal 1038 correspond to a first warmup of the engine 102 when combustion of the engine 102 is controlled according to the present disclosure. The combustion mode signal 1008, the engine speed signal 1012, the NOx SCR out signal 1016, the NOx/HC signal 1020, the NOx engine out signal 1024, the HC engine out signal 1028, the NH3 SCR out signal 1032, the EGT SCR inlet signal 1036, and the EGT SCRF inlet signal 1040 correspond to a second warmup of the engine 102 when combustion of the engine 102 is controlled according to the present disclosure. The emissions signals of FIG. 10 illustrate how the engine control system and method according to the present disclosure yields low emission levels during engine warmup.

The engine operating parameter signals are plotted with respect to an x-axis 1042 that represents time in seconds. The combustion mode signals 1006, 1008 are plotted with respect to a first y-axis 1044 that represents signal magnitude (unitless). The engine speed signals 1010, 1012 are plotted with respect to a second y-axis 1046 that represents engine speed in RPM. The NOx SCR out signals 1014, 1016 are plotted with respect to a third y-axis 1048 that represents mass per distance in milligrams per kilometer (mg/mi). The NOx/HC signals 1018, 1020 are plotted with respect to a fourth y-axis 1050 that represents mass per distance in mg/mi. The NOx engine out signals 1022, 1024 are plotted with respect to a fifth y-axis 1052 that represents mass in grams. The HC engine out signals 1026, 1028 are plotted with respect to a sixth y-axis 1054 that represents mass in grams. The NH3 SCR out signals 1030, 1032 are plotted with respect to a seventh y-axis 1056 that represents concentration in particles per million (ppm). The EGT SCR inlet signals 1034, 1036 are plotted with respect to an eight y-axis 1058 that represents temperature in ° C. The EGT SCRF inlet signals 1038, 1040 are plotted with respect to a ninth y-axis 1060 that represents temperature in ° C.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A system comprising:

a first exhaust gas temperature sensor configured to measure a first temperature of exhaust gas produced by an engine at a first location in an exhaust system of the engine;

a boost error module configured to determine a boost error of the engine, wherein the boost error is a difference between a target boost pressure of the engine and a current boost pressure of the engine; and a combustion control module configured to take the following actions when the first exhaust gas temperature is less than a first predetermined temperature:

select a target fuel injection parameter of the engine from a first set of target values when the boost error is less than or equal to a predetermined value, wherein the target fuel injection parameter includes at least one of a target fuel injection timing and a target number of fuel injections for a cylinder of the engine during each combustion cycle of the engine;

select the target fuel injection parameter from a second set of target values when the boost error is greater than the predetermined value, wherein the second set of target values is different than the first set of target values;

adjust the target fuel injection timing to a first fuel injection timing when the boost error is less than or equal to the predetermined value; and adjust the target fuel injection timing to a second fuel injection timing when the boost error is greater than the predetermined value, wherein the second fuel injection timing is advanced relative to the first fuel injection timing.

2. A system comprising:

a first exhaust gas temperature sensor configured to measure a first temperature of exhaust gas produced by an engine at a first location in an exhaust system of the engine;

a boost error module configured to determine a boost error of the engine, wherein the boost error is a difference between a target boost pressure of the engine and a current boost pressure of the engine; and a combustion control module configured to take the following actions when the first exhaust gas temperature is less than a first predetermined temperature:

select a target fuel injection parameter of the engine from a first set of target values when the boost error is less than or equal to a predetermined value, wherein the target fuel injection parameter includes at least one of a target fuel injection timing and a target number of fuel injections for a cylinder of the engine during each combustion cycle of the engine;

select the target fuel injection parameter from a second set of target values when the boost error is greater than the predetermined value, wherein the second set of target values is different than the first set of target values;

adjust the target number of fuel injections to a first number when the boost error is less than or equal to the predetermined value; and adjust the target number of fuel injections to a second number when the boost error is greater than the predetermined value, wherein the second number is less than the first number.

3. A system comprising:

a first exhaust gas temperature sensor configured to measure a first temperature of exhaust gas produced by an engine at a first location in an exhaust system of the engine;

a boost error module configured to determine a boost error of the engine, wherein the boost error is a difference between a target boost pressure of the engine and a current boost pressure of the engine; and a combustion control module configured to take the following actions when the first exhaust gas temperature is less than a first predetermined temperature:

select at least one of the target boost pressure, a target exhaust gas recirculated (EGR) flow rate of the engine, and a target fuel injection parameter of the engine from a first set of target values when the boost error is less than or equal to a predetermined value;

select the at least one of the target boost pressure, the target EGR flow rate, and the target fuel injection parameter from a second set of target values when the boost error is greater than the predetermined value, wherein the second set of target values is different than the first set of target values;

select the target boost pressure, the target EGR flow rate, and the target fuel injection parameter from the first set of target values when the boost error is less than or equal to the predetermined value; and select the target boost pressure, the target EGR flow rate, and the target fuel injection parameter from the second set of target values when the boost error is greater than the predetermined value.

4. The system of claim 3 further comprising a second exhaust gas temperature sensor configured to measure a second temperature of exhaust gas produced by the engine at a second location in the exhaust system, wherein the combustion control module is configured to:

select the target boost pressure, the target EGR flow rate, and the target fuel injection parameter from the first set of target values when the boost error is less than or equal to the predetermined value and the second exhaust gas temperature is less than or equal to a second predetermined temperature;

select the target boost pressure, the target EGR flow rate, and the target fuel injection parameter from the second set of target values when the boost error is greater than the predetermined value and the second exhaust gas temperature is less than or equal to the second predetermined temperature;

select the target boost pressure, the target EGR flow rate, and the target fuel injection parameter from a third set of target values when the boost error is less than or equal to the predetermined value and the second exhaust gas temperature is greater than the second predetermined temperature; and select the target boost pressure, the target EGR flow rate, and the target fuel injection parameter from a fourth set of target values when the boost error is greater than the predetermined value and the second exhaust gas temperature is greater than the second predetermined temperature.

5. The system of claim 4 wherein, for the same engine speed and the same engine load, the target boost pressure in the first set of target values is greater than the target boost pressure in the third set of target values, and the target boost pressure in the second set of target values is greater than the target boost pressure in the fourth set of target values.

6. The system of claim 4 wherein, for the same engine speed and the same engine load, the target EGR flow rate in the first set of target values is less than the target EGR flow rate in the third set of target values, and the target EGR flow rate in the second set of target values is less than the target EGR flow rate in the fourth set of target values.

7. The system of claim 4 wherein:

the target fuel injection parameter includes a target injection quantity;

the target injection quantity in the first and second sets of target values has a first variability; and the target injection quantity in the third and fourth sets of target values has a second variability that is greater than the first variability.

8. The system of claim 4 wherein:

the first exhaust gas temperature sensor is located at an inlet of a selective catalytic reduction (SCR) catalyst in the exhaust system;

the second exhaust gas temperature sensor is located at an inlet of a diesel oxidation catalyst in the exhaust system; and the second predetermined temperature is greater than the first predetermined temperature.

* * * * *